US006280222B1

(12) United States Patent
Walkup

(10) Patent No.: US 6,280,222 B1
(45) Date of Patent: Aug. 28, 2001

(54) LGA SOCKET WITH RELIABLE SECURING MECHANISM

(75) Inventor: William B. Walkup, Hillsboro, OR (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/625,233

(22) Filed: Jul. 25, 2000

(51) Int. Cl.[7] ..... H01R 13/62
(52) U.S. Cl. ..... 439/331; 361/704; 361/710
(58) Field of Search ..... 439/331, 330, 439/487, 342; 257/718, 719; 361/704, 710, 707, 709, 786, 787

(56) References Cited

U.S. PATENT DOCUMENTS

| | | | | |
|---|---|---|---|---|
| 3,904,262 | * | 9/1975 | Cutchaw | 439/71 |
| 4,063,791 | * | 12/1977 | Cutchaw | 439/331 |
| 5,256,080 | * | 10/1993 | Bright | 439/342 |
| 5,302,853 | * | 4/1994 | Volz et al. | 257/707 |
| 5,454,727 | * | 10/1995 | Hsu | 439/263 |
| 5,482,471 | * | 1/1996 | Mori et al. | 439/263 |
| 5,489,218 | * | 2/1996 | McHugh | 439/342 |
| 5,547,389 | * | 8/1996 | Hsu | 439/342 |
| 5,548,482 | * | 8/1996 | Hatauchi et al. | 361/720 |
| 5,569,045 | * | 10/1996 | Hsu | 439/342 |
| 5,600,540 | * | 2/1997 | Blomquist | 361/704 |
| 5,602,719 | * | 2/1997 | Kinion | 361/704 |
| 5,679,020 | * | 10/1997 | Lai et al. | 439/342 |
| 5,688,140 | * | 11/1997 | McHugh et al. | 439/342 |
| 6,004,141 | * | 12/1999 | Abe et al. | 493/73 |
| 6,021,045 | * | 2/2000 | Johnson | 361/704 |
| 6,083,022 | * | 7/2000 | Walkup | 439/260 |
| 6,086,387 | * | 7/2000 | Gallagher et al. | 439/71 |
| 6,191,480 | * | 2/2001 | Kastberg et al. | 257/727 |

* cited by examiner

*Primary Examiner*—Khiem Nguyen
*Assistant Examiner*—Michael C. Zarroli
(74) *Attorney, Agent, or Firm*—Wei Te Chung

(57) ABSTRACT

An electrical LGA socket (1) includes an electrical connector portion (11) and an insulative frame portion (10) surrounding the connector portion. The frame portion comprises a stationary element (12) and a driver (14) pivotally assembled to the stationary element. The stationary element comprises an opening (124) for accommodating the connector portion, a Land Grid Package (LGP)(13) and, a heat sink (3) and, a protrusion (120). First and second aligned retainers (22, 24) located opposite to the protrusion and a pair of opposite sides (122) surrounding the opening. The protrusion secures a second flange (312) of the heat sink. The driver comprises a lever (16) rotatable between an open and closed positions, a shaft (18) pivotally assembled to the first and second retainers, and a follower (20) assembled to the shaft and rotatable together with the shaft in response to rotation of the lever. The follower depresses a first flange (311) of the heat sink.

14 Claims, 10 Drawing Sheets

LGA SOCKET WITH RELIABLE SECURING MECHANISM

BACKGROUND OF THE INVENTION

1. Field of the Invention

The present invention relates to an electrical connector, and particularly to an electrical Land Grid Array (LGA) socket.

2. Description of the Related Art

Due to the ever increasing speed of microprocessors, there is an ever more pressing need to simplify the bottom surface of microprocessors by removing pins thereunder. A type of microprocessor exists which is called a leadless (/pinless) grid package, which is referred to by the acronym LGP. This technology has also been called land grid array or pinless grid array, and is identified by the acronym LGA.

These LGPs are usually used with heat sinks clamped tightly against them to physically conduct away the heat they generate and to dissipate the heat into the surrounding air. The heat sinks are pretty massive and must withstand rigorous environmental and handling requirements. The most common method (perhaps the only method) used to clamp the heat sinks in place is to fasten the heat sink directly to a printed circuit board using screws, nuts and washers, the LGP being connected to the circuit board directly beneath the heat sink. This approach is cumbersome to implement and there is always the risk that some small electrically conductive elements may get lost inside the computer, either during assembly or during replacement of the LGPs and the heat sinks. Furthermore, a tool is usually needed to assemble or replace the LGP and the heat sink and the tool is expensive and makes the procedure time-consuming.

Therefore, an improved connection device is required to overcome the disadvantages mentioned above.

SUMMARY OF THE INVENTION

A first object of the present invention is to provide an electrical Land Grid Array (LGA) socket which comprises a reliable securing mechanism for mounting a Land Grid Package (LGP) and a heat sink onto a printed circuit board; and Another object of the present invention is to provide an electrical LGA socket which reliably secures an LGP and a heat sink and which eliminates the use of an external tool during assembly or replacement of the LGP and the heat sink.

An electrical LGA socket in accordance with the present invention for mounting an LGP and a heat sink onto a printed circuit board comprises a frame portion mechanically mountable to the printed circuit board and a connector portion electrically connecting the LGP with the printed circuit board. The heat sink comprises a first flange and a second flange opposite to the first flange. The frame portion comprises a generally rectangular stationary element for receiving the connector portion, the LGP and the heat sink, and a driver pivotally assembled to the stationary element and cooperating with the stationary element to secure the LGP and the heat sink. The stationary element comprises a first and second retainers disposed at one side thereof and a projection opposite to the first and second retainers to secure the second flange of the heat sink. The driver comprises a lever, a shaft assembled to the lever and a follower assembled to the shaft. The shaft extends through the first retainer and the follower and is received by the second retainer. The shaft and the follower are rotatable in response to rotation of the lever. The follower is disposed in a space defined between the first and second retainers to secure the second flange of the heat sink.

Other objects, advantages and novel features of the invention will become more apparent from the following detailed description of the present embodiment when taken in conjunction with the accompanying drawings.

DETAILED DESCRIPTION OF THE INVENTION

FIGS. 1–9 illustrate an electrical Land Grid Array (LGA) socket 1 in accordance with a first embodiment of the present invention for mounting a Land Grid Package (LGP) 13 (FIG. 5) and a heat sink 3 to a printed circuit board (not shown). The LGA socket 1 comprises a frame portion 10 and a connector portion 11 (FIG. 5) removably received in the frame portion 10.

Figure 9:
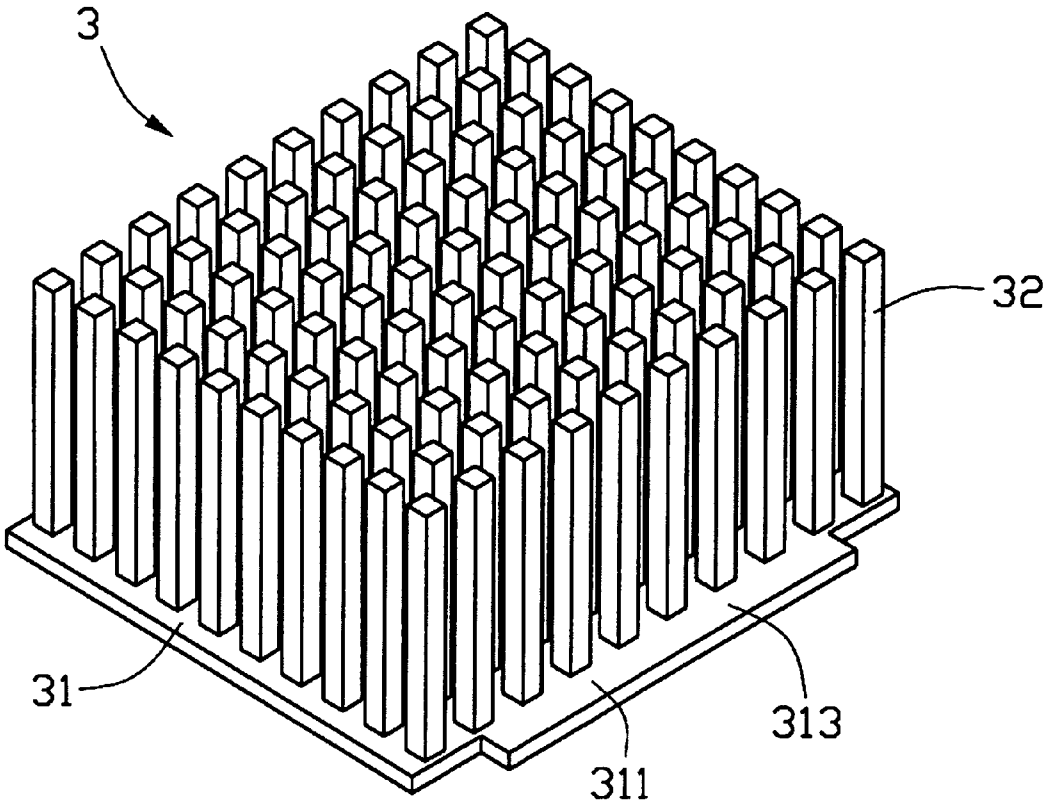
FIG. 9 is a perspective view of the heat sink with a second flange thereof shown.

Referring specifically to FIG. 9, the heat sink 3 comprises a base 31 and a plurality of heat-dissipating elements 32 vertically and upwardly extending from the base 31. The base 31 forms a first flange 312 (FIG. 5) extending outward from one edge thereof and a second flange 311 opposite to the first flange 312. The second flange 311 defines an upper surface 313 thereon. The first and second flanges 312, 311 are generally identical in shape. The heat-dissipating elements 32 may be in any configuration known in the art providing that they can effectively dissipate the heat produced by the LGP 13.

The connector portion 11 is in any Land Grid Array form known in the pertinent art and a detailed depiction of it is thus omitted. In addition, the LGP 13 is also conventional, thus, a detailed description thereof is also omitted.

The frame portion 10 comprises a generally rectangular stationary element 12 and a driver 14 pivotally assembled to the stationary element 12. The stationary element 12 defines an opening 124 (FIG. 5) in substantially a center thereof. An upward projection 120 is formed on one side of the stationary element 12 and defines a pair of screw holes 123 (only one shown) on opposite ends thereof and an elongated slot 121 (FIG. 5) therein between the two screw holes 123. A first and second retainers 22, 24 (FIG. 1) are integrally formed with the stationary element 12 and are located at a side opposite to the projection 120 and near respective ends of opposite sides 122 of the stationary element 12. Furthermore, the two retainers 22, 24 are aligned with each other and cooperatively define a space 23 therebetween. The end of each side 122 defines a screw hole 125 (only one shown). The first retainer 22 defines a hole (not shown) extending therethrough and the second retainer 24 defines a recess 241 (FIG. 3) therein.

Figure 2:
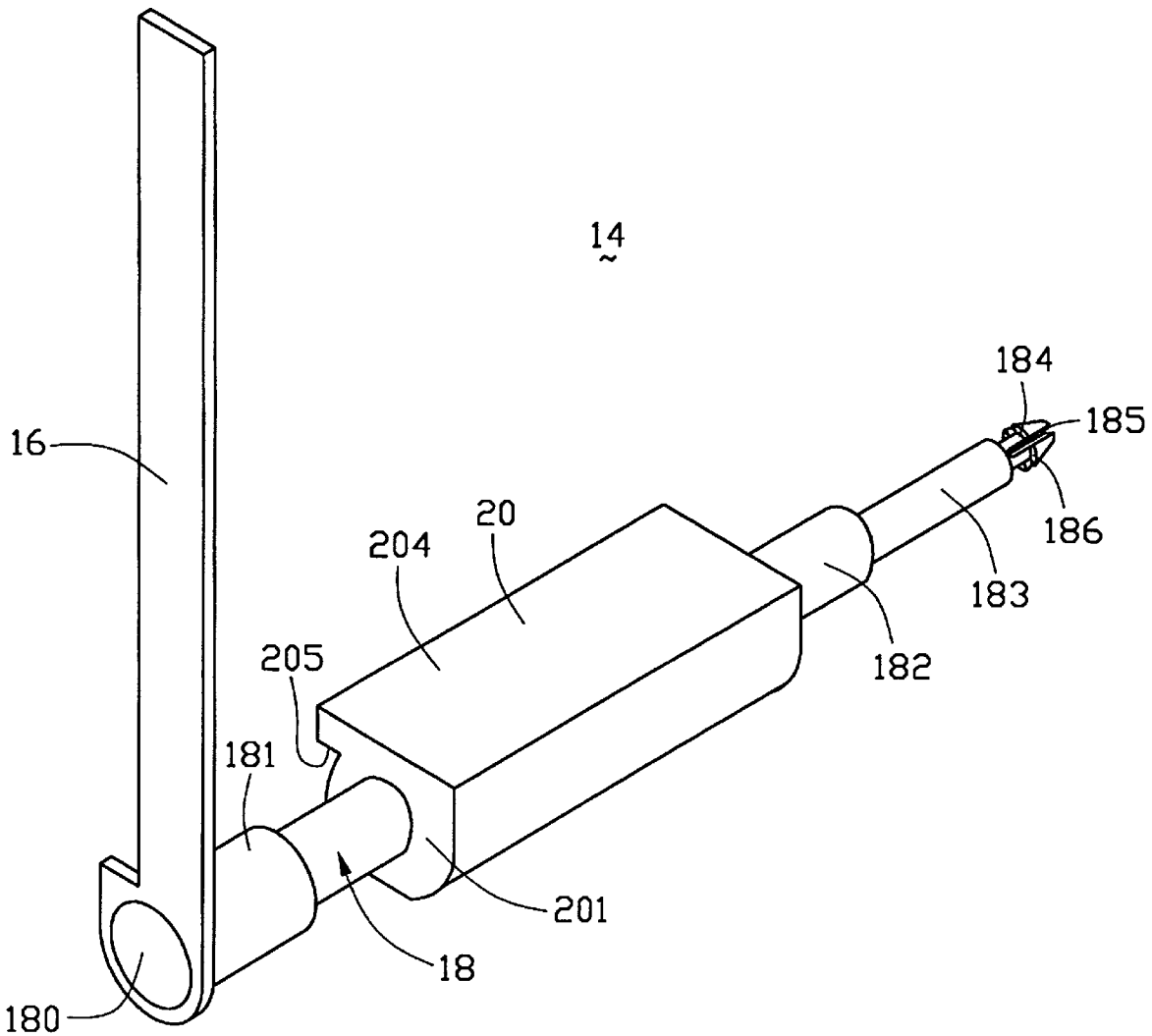
FIG. 2 is a perspective view of a driver of the socket of FIG. 1.
Figure 3:
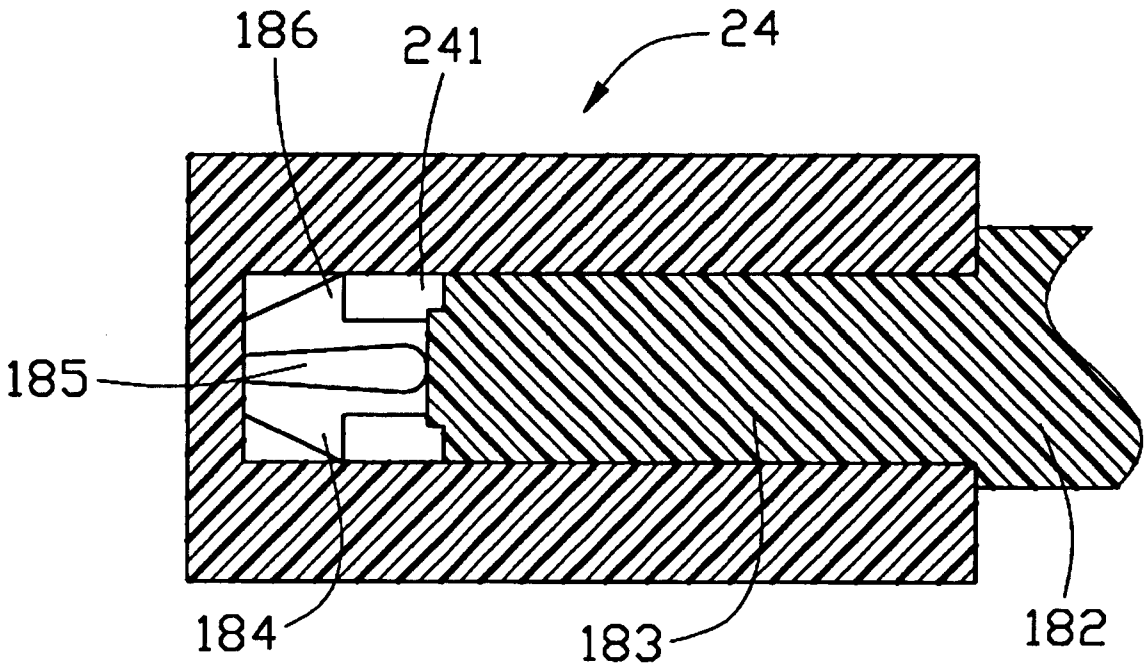
FIG. 3 is an enlarged cross-sectional view taken along line III—III of FIG. 1.

Referring specifically to FIG. 2, the driver 14 comprises a lever 16, a shaft 18, a follower 20 and a bushing 181. The shaft 18 is generally cylindrical and comprises an engaging portion 180 at one end thereof, a retention portion 183 at an opposite end thereof and a cam portion 182 between the engaging portion 180 and the retention portion 183. The bushing 181 is configured to correspond to the hole of the first retainer 22 and is fitted in the hole. The retention portion 183 comprises a head 184 at an end away from the cam portion 182. The head 184 has two longitudinally oriented slits 185 in an end thereof, the slits 185 being perpendicular to one another. An enlarged section 186 is formed at substantially a middle of the head 184. The retention portion 183 is dimensioned to be slightly smaller than the recess 241 of the second retainer 24, except for the enlarged section 186.

Referring specifically to FIGS. 2 and 6–8, a cross section of the cam portion 182 shows that the cam portion 182 includes a circular rod 187 having a center axis P and a protrusion 188 formed outward from the circular rod 187. An outer contour of the protrusion 188 is smoothly continuous with the outer contour of the circular rod 187 at one side thereof, but abruptly makes an inward bend to rejoin the outer contour of the circular rod 187 at an opposite side thereof. The surface of the protrusion at the inward bend constitutes an abutting face 189 which has a width h1.

The follower 20 comprises a pivotal portion 201 (FIG. 6) defining a through hole 202 therein and a stopping portion 203 forming a stopper 204 extending outwardly therefrom. The through hole 202 is designed to correspond to the cam portion 182 of the shaft 18 so that when the cam portion 182 rotates, the follower 20 is moved in a predetermined manner, as detailed below. The through hole 202 can be considered to be a combination of a cylindrical hole having a center axis Q and a recess communicating with a side of the cylindrical hole, wherein one side of the recess is defined by an urging face 206 on an inner surface of the pivotal portion 201, which corresponds to the abutting face 189 of the protrusion 188. The through hole 202 is a slightly larger than the cam portion 182 so that the cam portion 182 is rotatable in the through hole 202. The stopper 204 forms a stopping face 205 on a lower surface thereof.

In assembly, the follower 20 is disposed in the space 23 with the through hole 202 being aligned with the hole of the first retainer 22 and the recess 241 of the second retainer 24. The lever 16 is assembled to the shaft 18 by engaging with the engaging portion 180. The shaft 18 extends through the bushing 181 in the hole of the first retainer 22 and the through hole 202 of the follower 20 into the recess 241 of the second retainer 24. The head 184 provides a retention force between the driver 14 and the stationary element 12 by a spring force of the head 184 acting on the stationary element 12 since the head 184 is compressedly received in the recess 241.

In use, the assembled socket 1 is mounted to the printed circuit board via four bolts (not shown) extending through the screw holes 123, 125, respectively.

Figure 5:
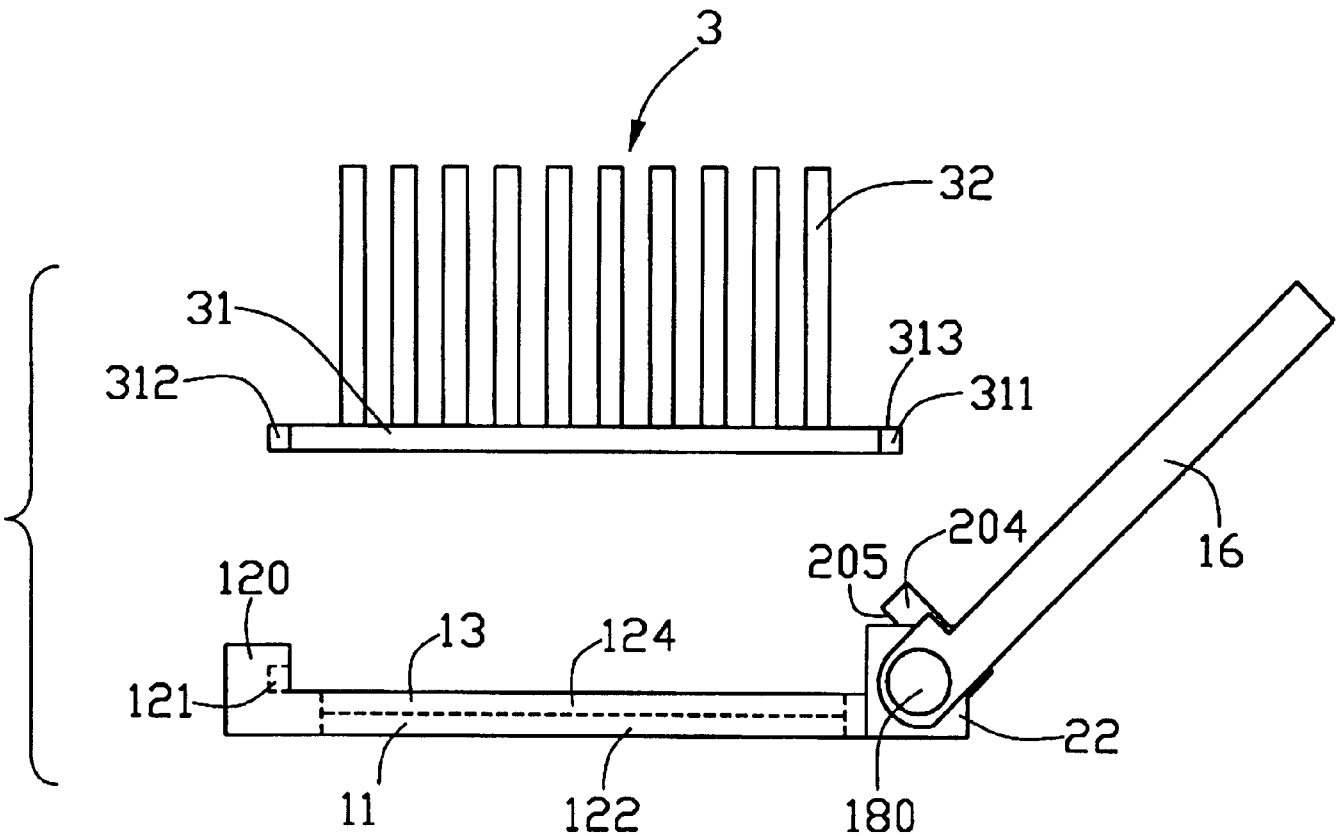
FIG. 5 is a side elevational view of the socket in the open position, wherein the heat sink is removed from and positioned above the socket and the LGP and a connector portion are shown in dotted lines.
Figure 6:
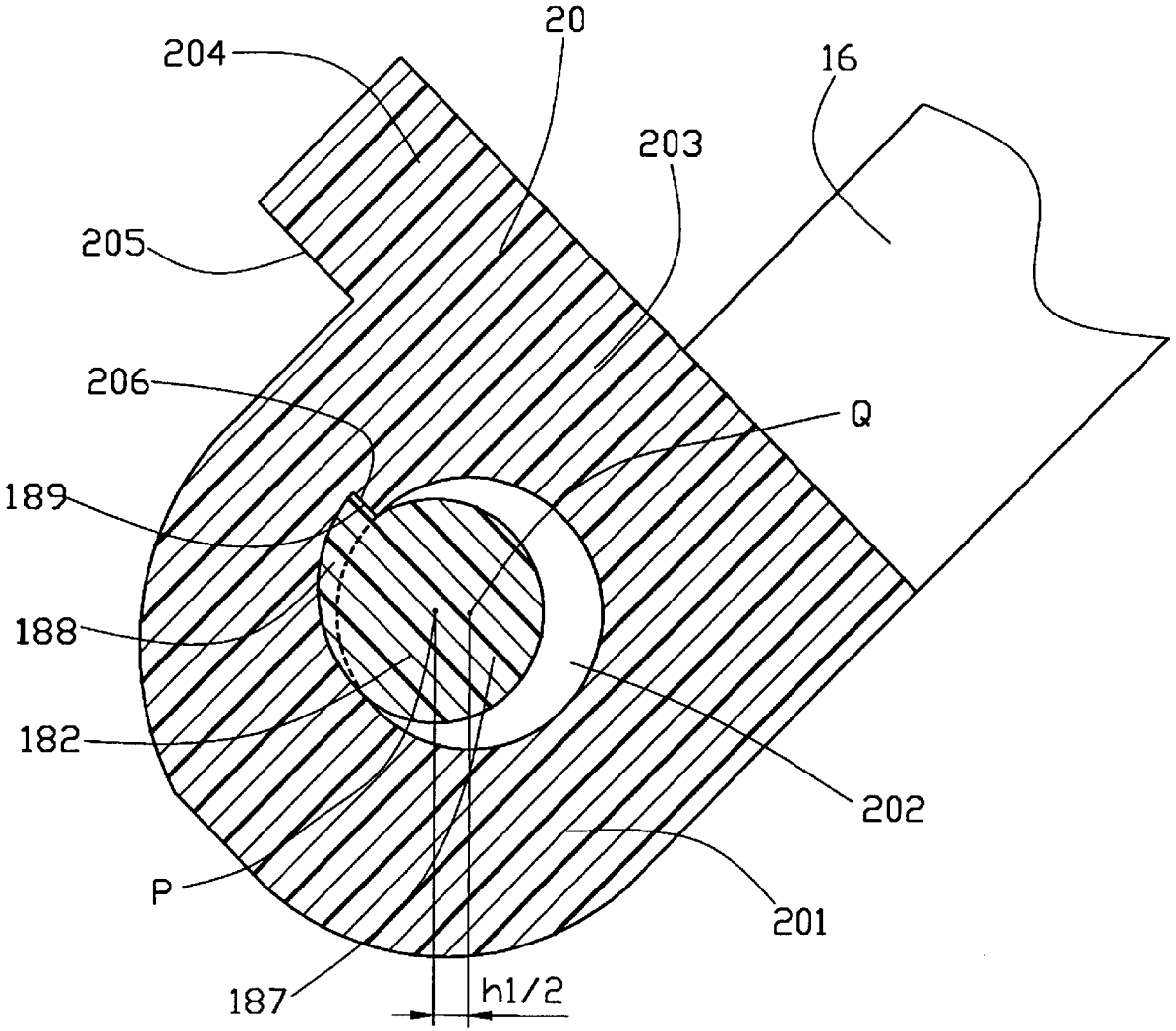
FIG. 6 is an enlarged cross-sectional view of the driver of the LGA socket in the open position.

Referring specifically to FIGS. 5 and 6, the lever 16 is pulled outwardly from the stationary element 12. The lever 16 drives the shaft 18 to pivot therewith. Since the abutting face 189 of the protrusion 188 abuts against the urging face 206 of the pivotal portion 201, the cam portion 182 then urges the follower 20 to rotate therewith to an open position of the socket 1 as shown in FIGS. 5 and 6. In this open position, an angle of 135 degrees is defined between a horizontal plane on which the stationary element 12 lies and the lever 16, and an angle of 45 degrees is defined between the stopper 204 and the horizontal plane. The center axis P of the cam portion 182 is spaced from the center axis Q of the through hole 202 a distance substantially equal to half of the width h1.

The connector portion 11 is disposed in the opening 124 and electrically mates with the printed circuit board via electrical contacts (not shown) thereof. The LGP 13 is put on the connector portion 11 thereby being mechanically supported by and electrically engaging with the connector portion 11. The heat sink 3 is stacked above the LGP 13, the first flange 312 extending into the slot 121 and the second flange 311 extending into the space 23 under the stopper 204. The upper surface 313 of the second flange 311 lies in a horizontal plane Al (FIGS. 7 and 8) parallel to the aforementioned horizontal plane.

Figure 4:
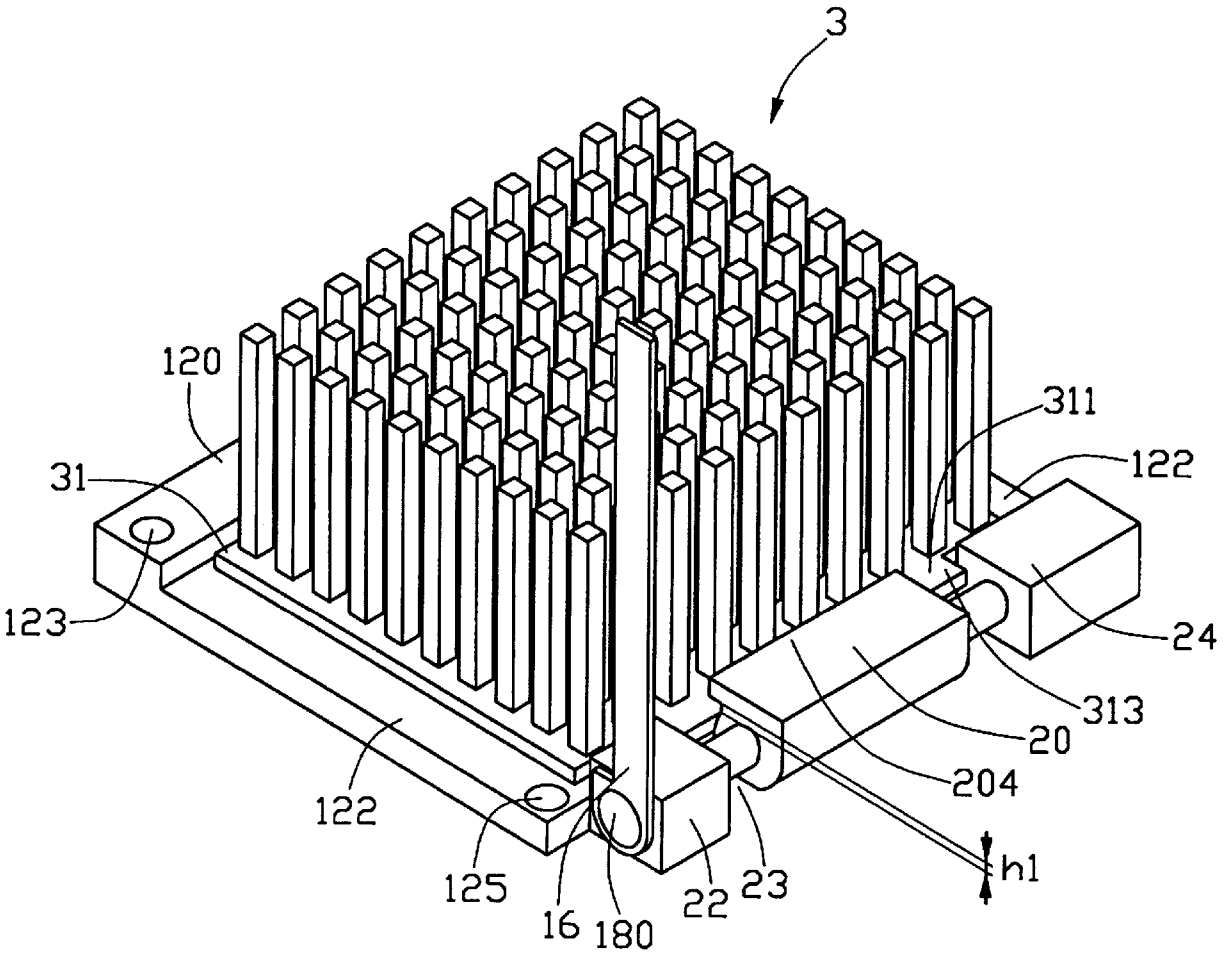
FIG. 4 is similar to FIG. 1, but the socket is in an intermediate position between a closed position and an open position thereof.
Figure 7:
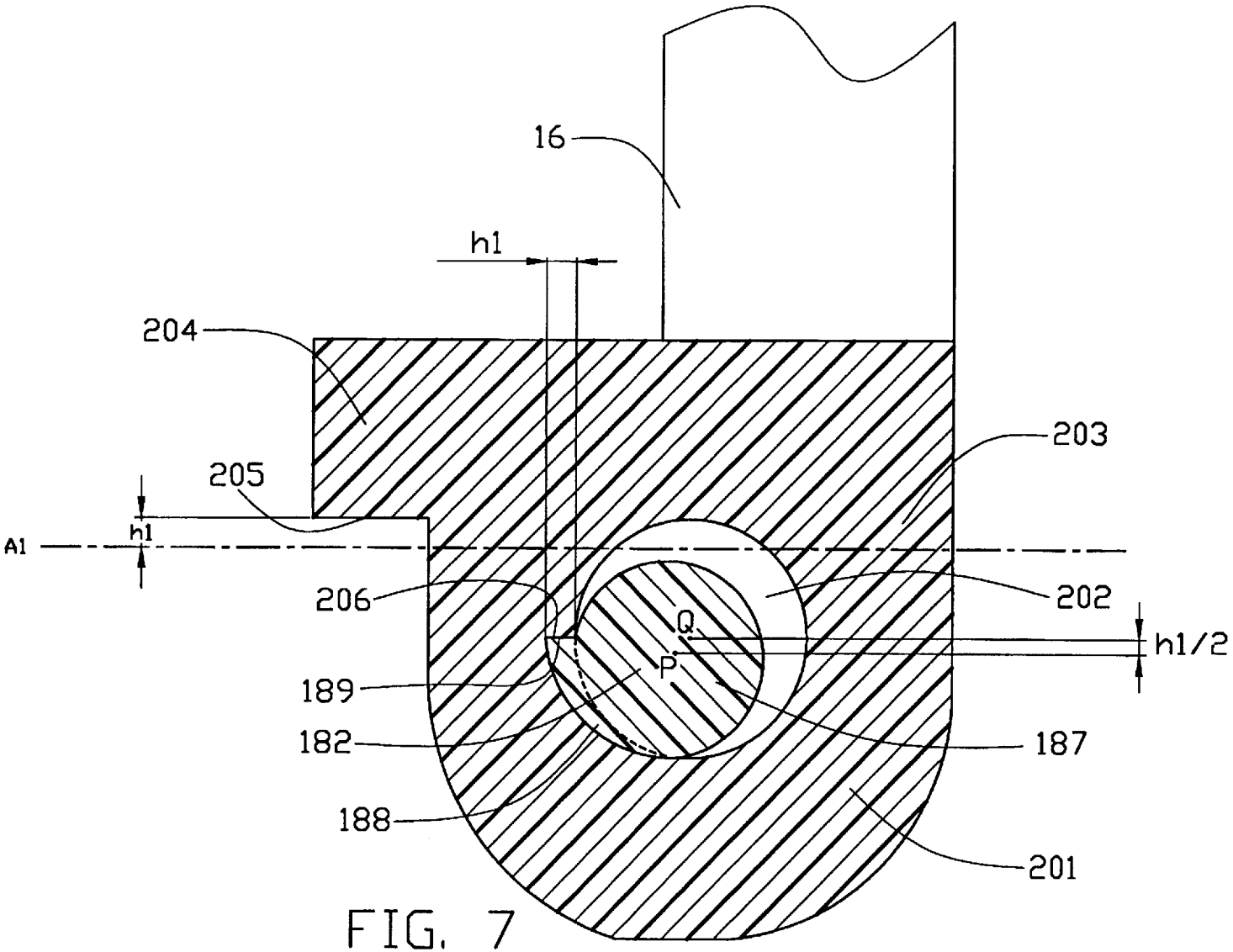
FIG. 7 is similar to FIG. 6 but the LGA socket is in the intermediate position.

Referring specifically to FIGS. 4 and 7, the lever 16 is rotated counterclockwise an angle of 45 degrees from its open position shown in FIG. 6, which actuates the shaft 18 and the follower 20 to pivot until they arrive at an intermediate position as shown in FIG. 7. In the intermediate position, the lever 16 is perpendicular to the plane A1. The stopper 204 is parallel to the plane A1 with the stopping surface 205 thereof being spaced from the plane A1 a vertical distance substantially equal to the width h1. The abutting face 189 still abuts against the urging face 206 and the center axis P of the cam portion 182 is below the center axis Q of the through hole 202 a distance substantially equal to half of the width h1.

Figure 1:
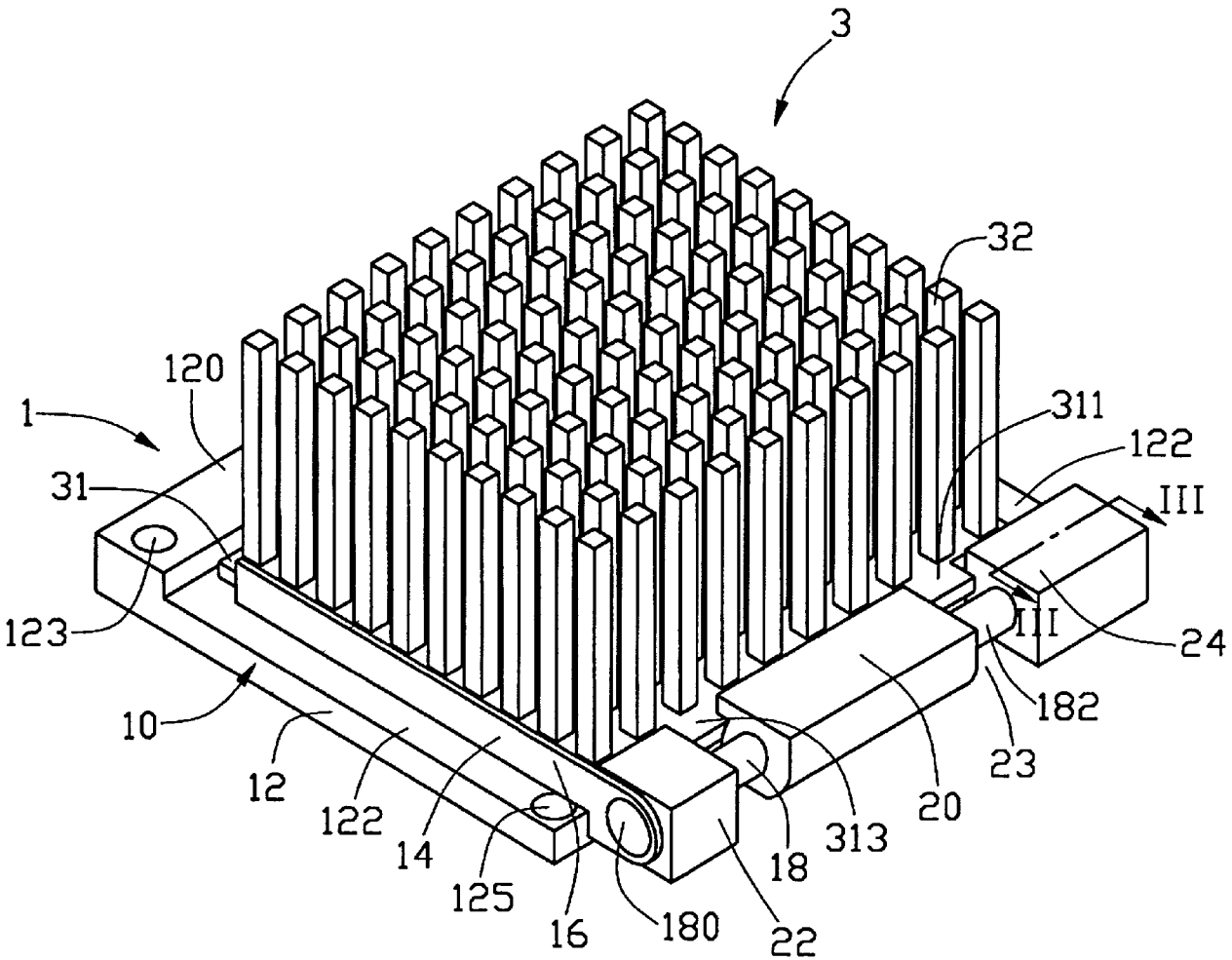
FIG. 1 is a perspective view of an electrical LGA socket in accordance with a first embodiment of the present invention, with an LGP and a heat sink locked in position, wherein the LGP is beneath the heat sink and is not visible.
Figure 8:
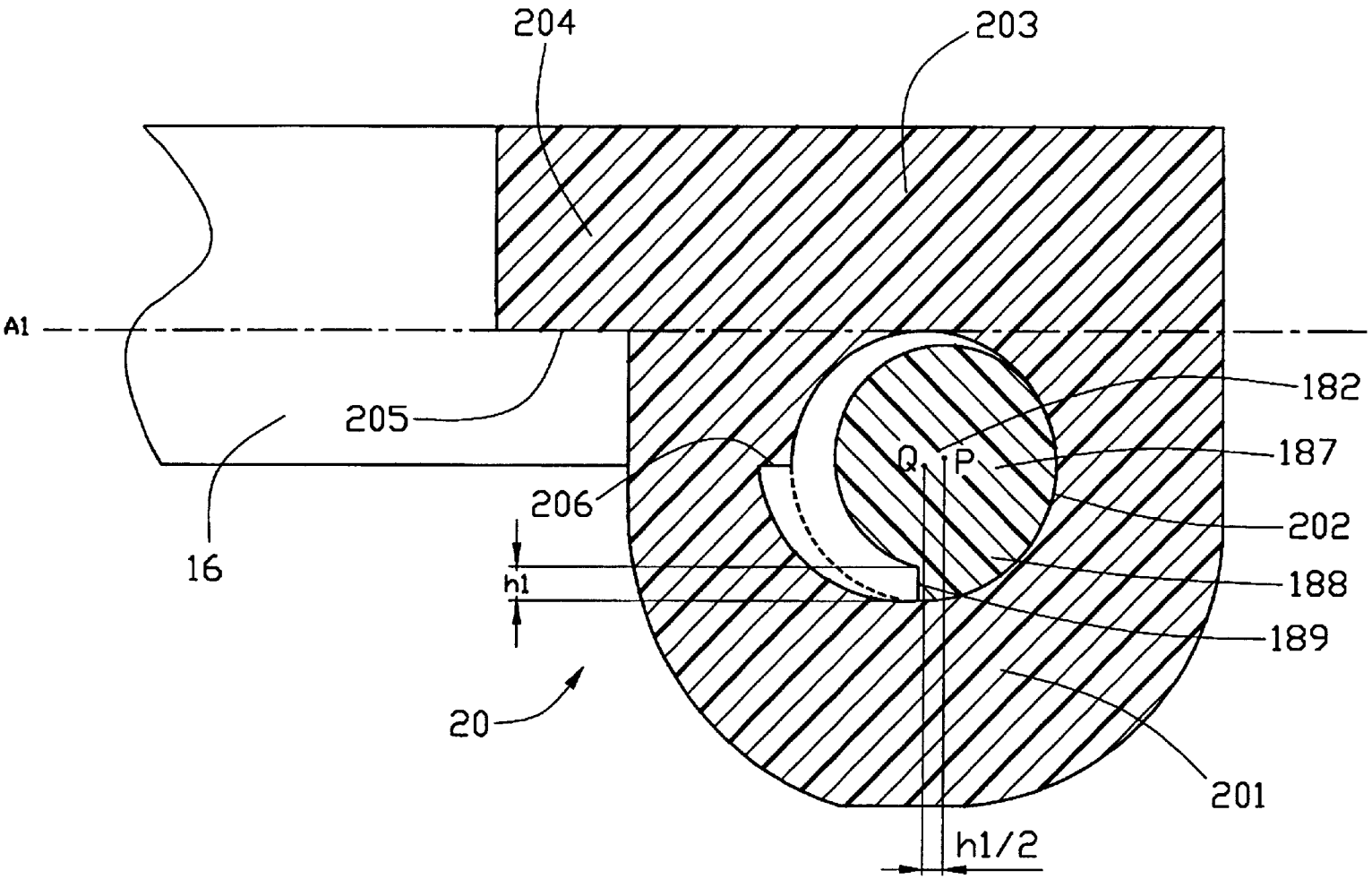
FIG. 8 is similar to FIG. 6 but the LGA socket is in the closed position.

Referring now to FIGS. 1 and 8, the lever 16 is further rotated counterclockwise and pivots the shaft 18 to a closed position. In this closed position, the lever 16 abuts against an upper surface of one of the sides 122. The follower 20 is depressed downward by the protrusion 188 of the cam portion 182 a distance substantially equal to the width h1 and the stopping face 205 abuts against the upper surface 313 of the second flange 311. The center axis Q is now to the left of the center axis P a distance substantially equal to half of the width h1, and an angle of 90 degrees is defined between the urging face 206 and the abutting face 189.

In this closed position, the connector portion 11, the LGP 13 and the heat sink 3 are secured in the socket 1, and the LGP 13 is reliably electrically connected with the printed circuit board via the connector portion 11, and the heat sink 3 is tightly engaged with the LGP 13.

When the LGP 13 and the heat sink 3 are required to be removed from the socket 1, the lever 16 is operated in a clockwise direction to unlock the follower 20 from the second flange 311 of the heat sink 3.

Figure 10:
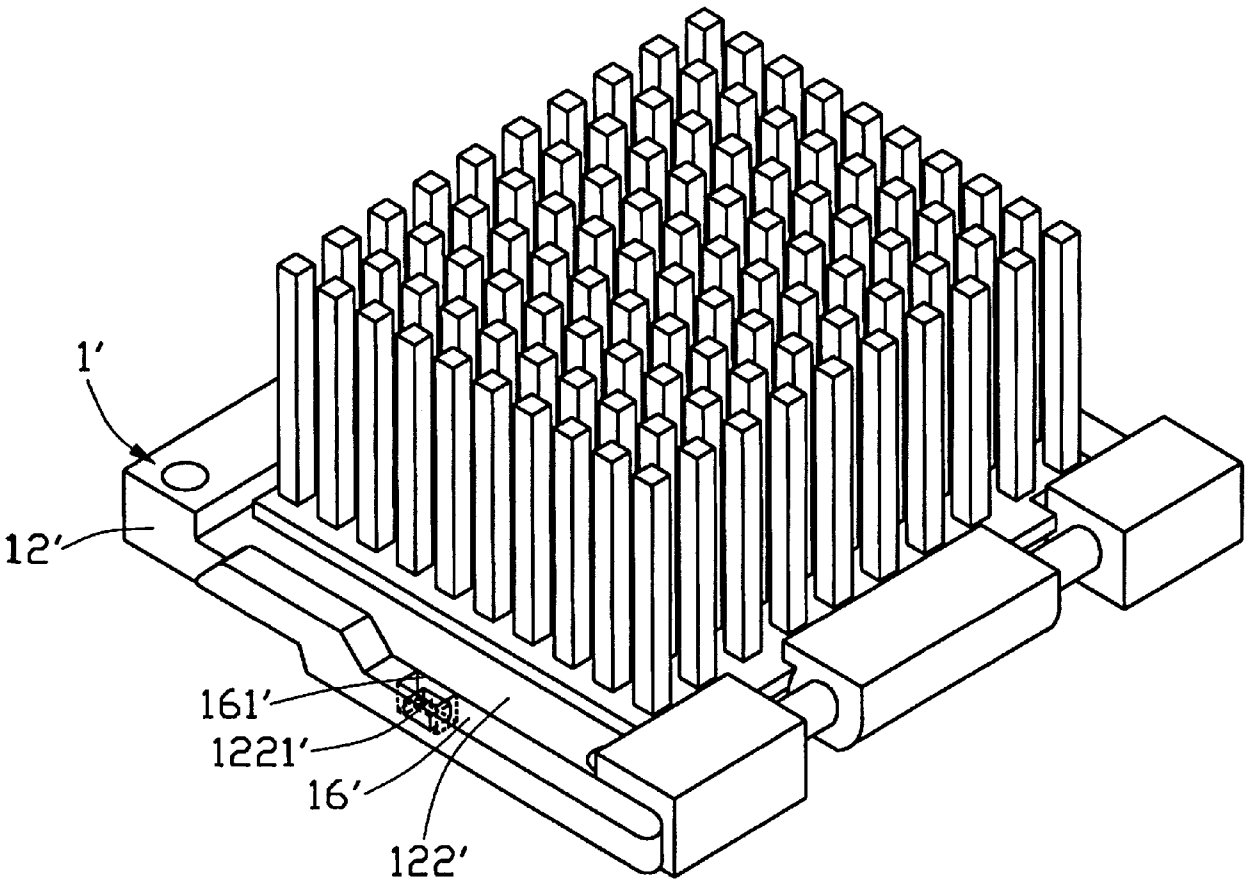
FIG. 10 is similar to FIG. 1 but illustrates a second embodiment of the present invention.

Referring to FIG. 10, an LGA socket 1' in accordance with a second embodiment of the present invention is shown. The LGA socket 1' is similar to the LGA socket 1 except that a recess 161' is defined in an inward side face of the lever 16' and a corresponding projecting portion 1221' is formed on an outward side face of the side 122' of the stationary element 12'. The projecting portion 1221' engages with the recess 161' and the inward side face of the lever 16' abuts against the outward side face of the side 122' when the LGA socket 1' is at the closed position thereby securely retaining the socket 1' at this position.

The LGA socket 1, 1' reliably secures the heat sink 3, the connector portion 11 and the LGP 13 together and eliminates the use of screws, nuts and washers and external tools. The assembling/replacing of the LGP 13 and the heat sink 3 to/from a printed circuit board is thus simplified and the cost is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combination of an electrical Land Grid Array (LGA) socket securing a Land Grid Package (LGP) and a heat sink therein, comprising:

an electrical connector portion for electrically connecting with an LGP; and an insulative frame portion surrounding the electrical connector portion, the frame portion comprising:

a stationary element comprising an opening receiving the electrical connector portion, the LGP and a heat sink, where the LGP is located between the electrical connector portion and the heat sink, a projection securing a first flange of the heat sink, and a first retainer and a second retainer aligned with the first retainer, the first and second retainers defining a space therebetween; and a driver pivotally assembled to the stationary element, the driver comprising a lever, a shaft comprising a cam portion forming a protrusion thereon and rotatably received in the first and second retainers, and a follower assembled to the cam portion of the shaft and comprising a through hole defining a recess corresponding to the protrusion, the follower being disposed in the space between the first and second retainers, the follower being drivable by the shaft to depress a second flange of the heat sink to the LGP.

2. The combination as claimed in claim 1, wherein the second retainer defines a recess for rotatably receiving the shaft therein.

3. The combination as claimed in claim 2, wherein the shaft comprises a retention portion comprising a head to be rotatably retained by the recess of the second retainer.

4. The combination as claimed in claim 3, wherein the recess has a diameter and the head comprises an enlarged section having a diameter slightly larger than the diameter of the recess.

5. The combination as claimed in claim 1, wherein the lever defines a recess in an inner surface thereof and a side of the stationary element forms a protrusion on an outer surface thereof corresponding to the recess of the lever.

6. The combination as claimed in claim 1, wherein the follower comprises a pivotal portion movable with the shaft and a stopping portion for depressing the second flange of the heat sink.

7. The combination as claimed in claim 6, wherein the stopping portion comprises a stopper protruding outwardly therefrom and the stopper defines a stopping face for abutting against an upper surface of the second flange of the heat sink.

8. The combination as claimed in claim 1, wherein the projection of the stationary element defines a slot therein which receives the first flange of the heat sink.

9. An apparatus of an LGA socket for securing an LGP and a heat sink therein, comprising:

a frame portion comprising:

a stationary element defining an opening for receiving therein, in sequence, a connector portion of the LGA socket, an LGP and a heat sink, the stationary element comprising a projection defining a slot for securing a first flange of the heat sink, a first and second retainers defining a space therebetween and being aligned with each other, and a pair of opposite sides connecting the projection with the first and second retainers; and a driver comprising a lever abuttable to one of the opposite sides, a shaft fixed to the lever at one end thereof and assembled to the first and the second retainers, and a follower assembled to the shaft and disposed in the space between the first and second retainers, the follower being drivable by the lever for depressing a second flange of the heat sink.

10. The apparatus as claimed in claim 9, wherein the shaft comprises a retention portion on an end thereof and the second retainer defines a recess therein for receiving the retention portion.

11. An electrical assembly comprising:

a Land Grid Package (LGP);

a heat sink disposed on the LGP, the heat sink comprising a first flange extending outwardly from one side thereof and a second flange extending opposite to the first flange; and an electrical Land Grid Array (LGA) socket comprising:

an electrical connector portion disposed below and electrically connected with the LGP; and an insulative frame portion comprising a stationary element defining an opening receiving the electrical connector portion, the LGP and the heat sink, and a driver pivotally assembled to the stationary element, the stationary element comprising a projection defining an elongate slot receiving the first flange of the heat sink, a first retainer, and a second retainer aligned with the first retainer, a space being defined between the first retainer and the second retainer, the driver comprising a shaft, a lever and a follower, the shaft comprising a cam portion, the cam portion comprising a protrusion having an abutting face, the lever being assembled to the shaft and driving the shaft, the follower comprising a through hole receiving the cam portion and an urging face corresponding to the abutting face, the follower being received in the space and being operated by the shaft to move between a first position where the follower depresses the second flange of the heat sink, and a second position where the follower moves away from the second flange.

12. An electrical connector assembly comprising:

a frame defining an opening therein;

a connector portion being removably received in the opening;

an integrated circuit being received in the opening, located on the connector portion and electrically connecting therewith;

a heat sink located on the integrated circuit and in contact therewith, said heat sink having a base and a number of heat-dissipating elements projecting upwardly from the base, said base having a first portion engaging with the frame and a second portion different from the first portion;

a shaft with a cam portion pivotally connected to the frame, a follower drivably connected to the cam portion, the follower being movable by rotating the shaft to move between an open position and a closed position, at the open position, the follower having no engagement with the heat sink, and at the closed position, the follower depressing the second portion of the base of the heat sink toward the integrated circuit, the follower being movable between the open and the closed positions via an intermediate position, from the open to the intermediate position, said follower having a pivaing movement, and from the intermediated position to the closed position, said follower having a linear movement.

13. An electrical connector assembly comprising:

a socket defining a frame and a connection portion in the frame, a projection formed on one end of said frame;

a shaft with a cam portion pivotably connected to the other end of the frame opposite to said end;

a follower rotatably surrounding the cam portion with a stopper thereon; and a heat sink defining a first end engaged with the projection and a second end, opposite to said first end, pressed downwardly by the stopper; wherein the follower is associatively rotated with the shaft to have the stopper pivotally moved away from the frame for loading/unloading the heat sink to the frame when the shaft is rotatably moved from an intermediate position to an open position, while the follower is downwardly moved, without rotation, to press downwardly against the heat sink thereunder when the shaft is rotatably moved from the intermediate position to a locked position.

14. A combination of an electrical Land Grid Array (LGA) socket securing a Land Grid Package (LGP) and a heat sink therein, comprising:

an electrical connector portion for electrically connecting with an LGP; and an insulative frame portion surrounding the electrical connector portion, the frame portion comprising:

a stationary element comprising an opening receiving the electrical connector portion, the LGP and a heat sink, where the LGP is located between the electrical connector portion and the heat sink, a projection securing a first flange of the heat sink, and a first retainer and a second retainer aligned with the first retainer, the first and second retainers defining a space therebetween; and a driver pivotally assembled to the stationary element, the driver comprising a lever, a shaft rotatably received in the first and second retainers and a follower assembled to the shaft and disposed in the space between the first and second retainers, the second retainer defining a recess having a diameter, the shaft comprising a retention portion comprising a head, the head being rotatably retained by the recess of the second retainer and comprising an enlarged section having a diameter slightly larger than the diameter of the recess, the follower being drivable by the shaft to depress a second flange of the heat sink to the LGP.

* * * * *